US008779678B2

(12) United States Patent
Roberts et al.

(10) Patent No.: US 8,779,678 B2
(45) Date of Patent: Jul. 15, 2014

(54) SEGMENTED ELECTRONIC ARC LAMP BALLAST

(76) Inventors: Dudley Allan Roberts, Penrose, NC (US); John Keen Mathews, Weaverville, NC (US)

( * ) Notice: Subject to any disclaimer, the term of this patent is extended or adjusted under 35 U.S.C. 154(b) by 0 days.

(21) Appl. No.: 13/587,623

(22) Filed: Aug. 16, 2012

(65) Prior Publication Data

US 2013/0049627 A1 Feb. 28, 2013

Related U.S. Application Data

(60) Provisional application No. 61/527,758, filed on Aug. 26, 2011, provisional application No. 61/526,538, filed on Aug. 23, 2011.

(51) Int. Cl.
*H05B 41/16* (2006.01)

(52) U.S. Cl.
USPC ..... 315/246

(58) Field of Classification Search
USPC ..... 315/224, 246, 307, 209 R, 308, 119, 86, 315/106, 223, 135
See application file for complete search history.

(56) References Cited

U.S. PATENT DOCUMENTS 4,219,868 A 8/1980 Bowman et al.
4,506,195 A 3/1985 Elms
5,030,889 A 7/1991 El-Hamamsy et al.
5,508,592 A 4/1996 Lapatovich et al.
5,545,955 A 8/1996 Wood
5,811,941 A 9/1998 Barton
6,049,179 A 4/2000 Kisaichi et al.
6,127,782 A * 10/2000 Flory et al. ..... 315/129
6,211,623 B1 4/2001 Wilhelm et al.
6,259,614 B1 7/2001 Ribarich et al.
6,288,501 B1 9/2001 Nakamura et al.
6,617,805 B2 9/2003 Ribarich et al.
6,639,369 B2 10/2003 Ribarich
6,650,067 B1 11/2003 Shloush et al.
6,680,585 B2 1/2004 Trestman
6,956,336 B2 10/2005 Ribarich
6,969,034 B2 11/2005 Ware et al.
7,084,578 B2 8/2006 Gong
7,109,668 B2 9/2006 Pogodayev et al.
7,129,647 B2 10/2006 Dulaney et al.
7,154,232 B2 12/2006 Contenti et al.
7,190,151 B2 3/2007 Ribarich et al.
7,420,338 B2 9/2008 Ribarich
7,507,001 B2 3/2009 Kit
7,563,003 B2 7/2009 Powell
7,619,367 B2 * 11/2009 Van Zundert et al. ..... 315/160

(Continued)

*Primary Examiner* — Thienvu Tran
(74) *Attorney, Agent, or Firm* — Oliff PLC

(57) ABSTRACT

Described herein are segmented electronic ballasts for a high power are lamp, such as a High Intensity Discharge ("HID") lamp, capable of drop-in replacement of a pre-existing magnetic ballast and methods of use thereof. In certain aspects, the segmented electronic ballasts described herein include a first housing containing a driver circuit configured to receive electrical power from a source of electrical power and configured to output a conditioned power signal; and also include a second housing containing a striker circuit connected to the driver circuit and configured to receive the conditioned power signal and ignite the lamp. In certain aspects, the methods described herein include removing a transformer of the pre-existing magnetic ballast from a transformer mounting position; and also include fixing the first housing to the transformer mounting position.

24 Claims, 15 Drawing Sheets

(56) References Cited

U.S. PATENT DOCUMENTS

| | | | |
|---|---|---|---|
| 7,771,095 | B2 | 8/2010 | Dorogi |
| 7,977,893 | B2 | 7/2011 | Ribarich |
| 7,982,411 | B2 | 7/2011 | Hollander |
| 2007/0070584 | A1 | 3/2007 | Quazi |
| 2008/0111497 | A1 | 5/2008 | Yanai et al. |
| 2008/0238334 | A1 | 10/2008 | Green |
| 2009/0033238 | A1 | 2/2009 | Hollander |
| 2011/0025231 | A1 | 2/2011 | Gordin et al. |

* cited by examiner

SEGMENTED ELECTRONIC ARC LAMP BALLAST

RELATED APPLICATIONS

This application is based on and claims benefit of U.S. Provisional Application No. 61/526,538, filed Aug. 23, 2011, entitled "Drop-In Electronic Ballast for HID Lamps," and of U.S. Provisional Application No. 61/527,758, filed Aug. 26, 2011, entitled "Separable Striker Circuit for HID Lamp Ballasts." A claim of priority to these prior applications is hereby made, and the disclosures of these prior applications are hereby incorporated by reference.

FIELD OF THE APPLICATION

The present application relates generally to electronic ballast lighting control devices for high power are lamps. More specifically, the present application pertains to a segmented electronic arc lamp ballast for a High Intensity Discharge ("HID") lamp configured so as to directly replace a pre-existing magnetic ballast in a light fixture without substantial modification to the environment surrounding the HID light fixture or to the HID light fixture itself. The present application also pertains to a method of replacing the pre-existing magnetic ballast using the aforementioned segmented electronic are lamp ballast.

BACKGROUND

High Intensity Discharge ("HID") lamps, being among the most efficient light sources available at up to 100 lumens per Watt, are frequently used for large area illuminations. For example, the number of installed HID units worldwide exceeds 400 million, and by one estimate, approximately eight percent of the world's electricity production is used in HID lighting. Additionally, more than half of these installed 400 million units are used for roadway and parking area lighting, and approximately half of these installed 400 million units make use of either 250 W or 400 W lamps.

However, due to the negative resistance characteristic of HID lamps, electrical ballasts are required to ignite and thereafter limit the flow of current to the HID lamp. Thus, the electrical ballast device has three primary functions: (1) lamp ignition, (2) lamp power control, and (3) control of AC line transients and power quality.

Traditionally, the above tasks have been accomplished through the use of magnetic ballasts similar to those utilized in fluorescent lighting that incorporate metal coil transformers. However, magnetic ballasts have several inherent deficiencies. For example, in addition to being physically heavy, magnetic ballasts frequently produce a magnetic humming noise, are inefficient at converting input power to proper lamp power, and have less-than-ideal "power factors," thereby creating difficulties for local power companies. Moreover, magnetic ballasts are typically not dimmable, must be replaced every five to ten years, and power line variation can impact the output of the magnetic ballast, thereby creating fluctuations in the output of the connected HID lamp. Accordingly, recent efforts to improve HID lighting have led to the introduction and promotion of electronic arc lamp ballasts as an alternative to the older magnetic ballasts.

FIG. 1 provides a circuit diagram of a typical electronic are lamp ballast known to those skilled in the art, and FIG. 2 provides a perspective view of the housing of such a typical electronic arc lamp ballast. Compared to magnetic ballasts, electronic ballasts are lighter (up to 11 pounds), more efficient (up to 30%), quieter, have longer service lives, and have a nearly-perfect "power factor" (99% compared to an upper limit of approximately 90% for magnetic ballasts). However, the widespread adoption of electronic ballasts has been tempered, at least in part, by the difficulty associated with retrofitting existing light fixtures designed for magnetic ballasts with electronic ballasts. In particular, currently-available electronic ballasts for HID lamps are often simply too large to fit within the housings of many HID light fixtures. Additionally, currently-available electronic ballasts for HID lamps are not configured to dissipate heat through the housing of the HID light fixture as are pre-existing magnetic ballasts, thereby creating over-heating problems within the electronic ballast even if it were able to fit within the housing of the HID light fixture. Thus, to retrofit HID light fixtures using pre-existing magnetic ballasts with newer electronic ballasts, significant infrastructure modifications are often required, thereby drastically increasing the cost of such a project and making it much more difficult to recover from an upgrade to electronic ballasts should the decision to do so later be reversed.

SUMMARY

To address the above difficulty, described herein are segmented electronic ballasts for a high power arc lamp, such as a High Intensity Discharge ("HID") lamp, capable of drop-in replacement of a pre-existing magnetic ballast and methods of use thereof, In certain aspects, the segmented electronic arc lamp ballasts include a noise filter circuit, a power supply circuit, a lamp driver circuit, a current control circuit, and an ignition circuit. The noise filter circuit, power supply circuit, and lamp driver circuit are all housed in a first, ballast housing, and the current control circuit and the ignition control circuit are housed in a second, striker housing. In certain aspects, the noise filter circuit is separated from the ballast housing and contained in a third, filter housing. In certain aspects, an interlock element is included that prevents activation of the circuits within the ballast housing in the event the striker housing is disconnected. In certain aspects, the physical dimensions of the ballast housing correspond to those of a comparably-rated core and coil transformer of a pre-existing magnetic ballast. In certain aspects, thru-holes of the ballast housing correspond to those of the comparably-rated core and coil transformer.

Further described herein are methods of use of the segmented electronic arc lamp ballast so as to replace the pre-existing magnetic ballast of a light fixture. In certain aspects, the light fixture includes a housing possessing mounting positions for the transformer and for a filter capacitor of the pre-existing magnetic ballast. In certain aspects, the housing possesses an additional mounting position for an igniter of the pre-existing magnetic ballast. In certain aspects, the transformer of the pre-existing magnetic ballast is fixed in the transformer mounting position via a transformer mounting apparatus. The methods described herein can include removing the individual elements of the pre-existing magnetic ballast and replacing them with the above-described elements of the segmented electronic arc lamp ballast. In certain aspects, the ballast housing is fixed in the transformer mounting position; the striker housing is fixed in the filter capacitor mounting position; and the filter housing is fixed in the igniter mounting position. In certain aspects, the ballast housing and the striker housing are both fixed in the transformer mounting position. In certain aspects, the ballast housing, the striker housing, and the filter housing are all fixed in the transformer mounting position. In certain aspects, the ballast housing is fixed in the transformer mounting position using the transformer mounting apparatus.

BRIEF DESCRIPTION OF THE DRAWINGS

FIG. 5C shows an isometric view of a first embodiment of the transformer mounting apparatus 230.

FIG. 80 shows an interior cut-away of the housing 220 of the typical HID light fixture 200 with the segmented electronic arc lamp ballast 1 installed.

DETAILED DESCRIPTION OF THE EMBODIMENTS

Figure 1:
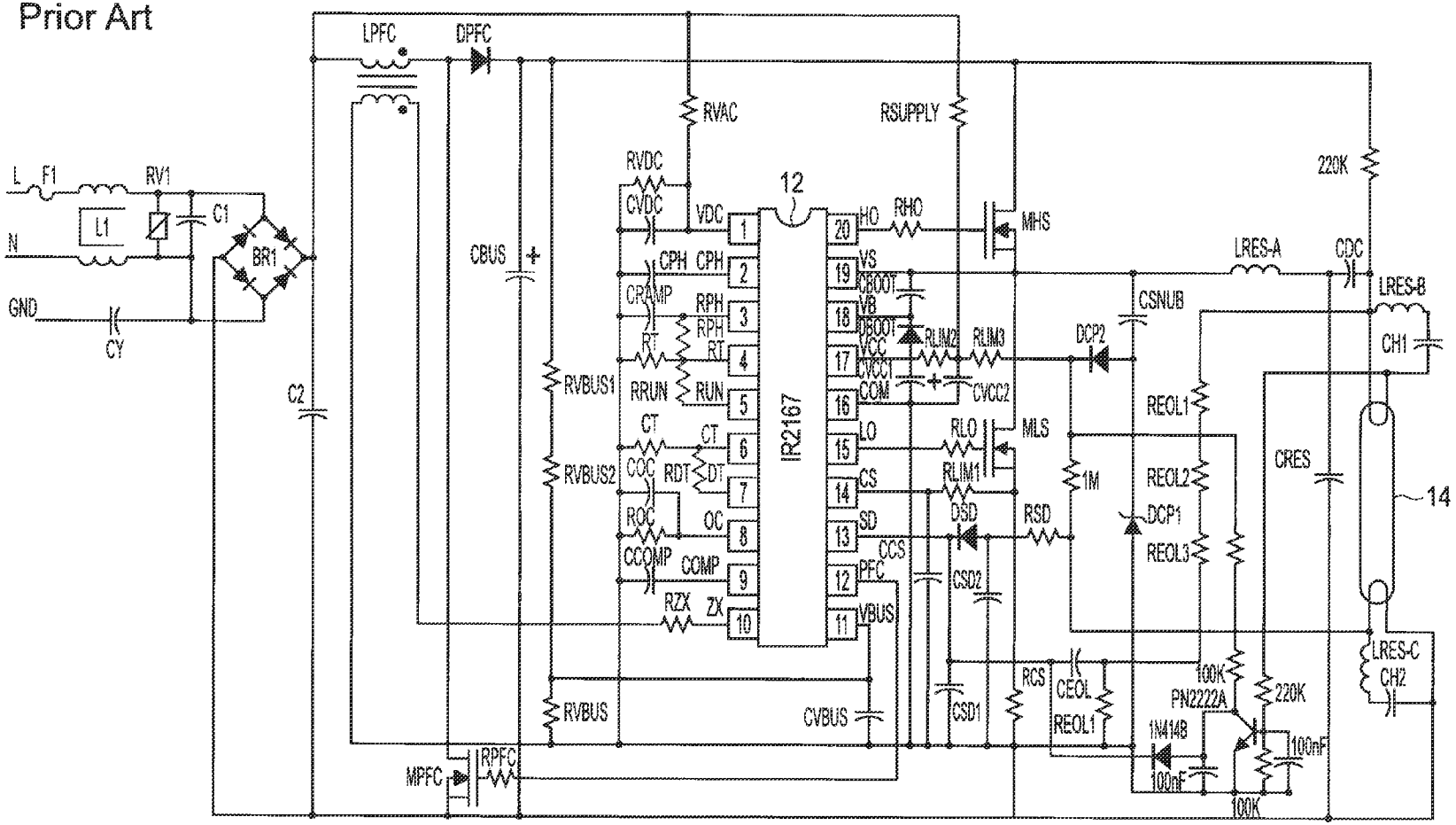
FIG. 1 Prior Art
FIG. 1 shows a circuit diagram of a related art electronic arc lamp ballast.

Hereinafter, embodiments of a segmented electronic arc lamp ballast 1 will be explained in more detail with reference to the provided drawings. It is to be understood that, in the description that follows, like elements are marked throughout the specification with the same reference numerals.

Figure 3:
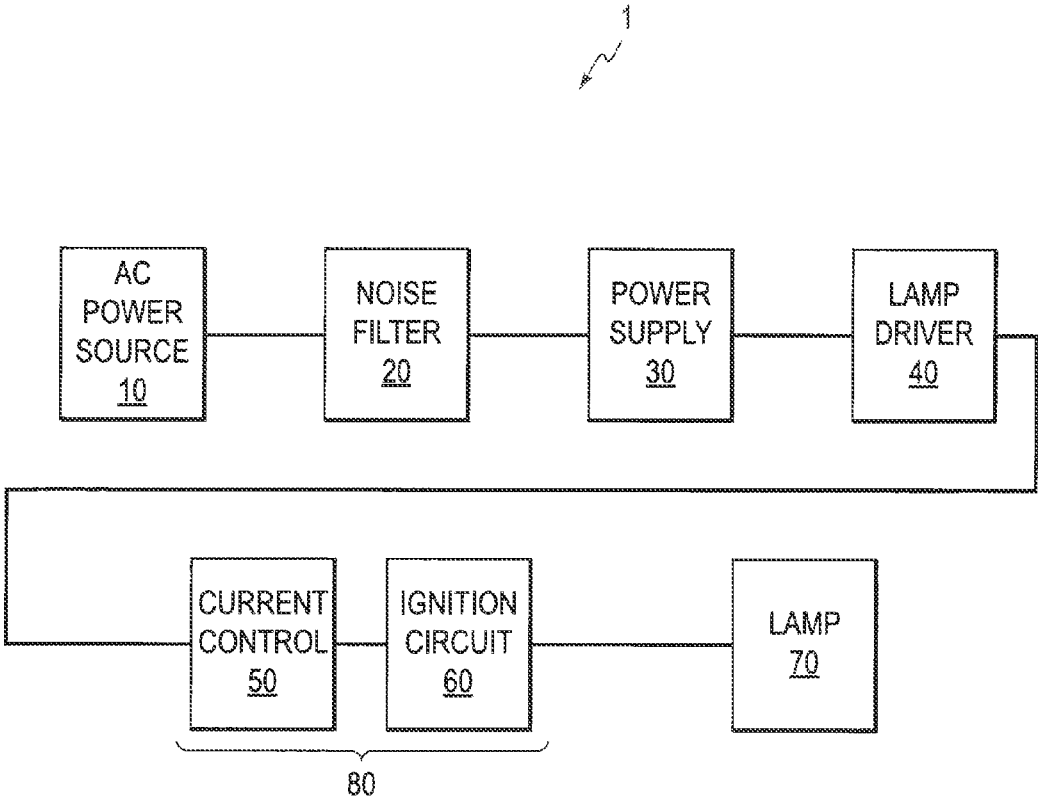
FIG. 3 shows a block circuit diagram of an exemplary segmented electronic arc lamp ballast 1.

FIG. 3 provides a block circuit diagram of an exemplary embodiment of the segmented electronic are lamp ballast 1 for a high power arc lamp such as a High Intensity Discharge ("HID") lamp. As can be seen in FIG. 3, the segmented electronic arc lamp ballast 1 can include a noise filter circuit 20, a power supply circuit 30, a lamp driver circuit 40, a current control circuit 50, and an ignition circuit 60. An AC power source 10 can be electrically connected to the noise filter circuit 20, and a lamp 70 can be electrically connected to the ignition circuit 60. In certain aspects, the noise filter circuit 20 is omitted from the segmented electronic arc lamp ballast 1. In certain aspects, the power supply circuit is supplemented with a power factor correction circuit.

The AC power source 10 is archetypal of that found in many developed countries. In certain aspects, the AC power source 10 operates between 100V-300V and at frequencies ranging from 50 Hz-60 Hz. More specifically, regions transmitting at 60 Hz, such as the Americas, typically utilize voltages of 120V, 208V, 240V, or 278V in the non-residential locations where HID lamps are most often employed, and regions transmitting at 50 Hz, such as most of Europe, typically utilize voltages ranging from 220V-240V. Certain locations run higher wattage lamps at 440V.

The noise filter circuit 20 ensures compliance with FCC requirements and, to some extent, maintains stable operation of the segmented electronic arc lamp ballast 1 by separating the AC power source 10 from the latter circuits 30, 40, 50, 60 of the segmented electronic arc lamp ballast 1. To do so, the noise filter circuit 20 may perform two primary functions. First, the noise filter circuit 20 may have the primary function of preventing noise generated by the high-speed switching of inductive circuits internal to the segmented electronic are lamp ballast 1 from propagating to the AC power source 10. Additionally, the noise filter circuit 20 may have the secondary function of preventing noise transmitted from the AC power source 10, such as that accompanying a supplied overvoltage, from propagating into the electronic arc lamp ballast 1.

Figure 4A:
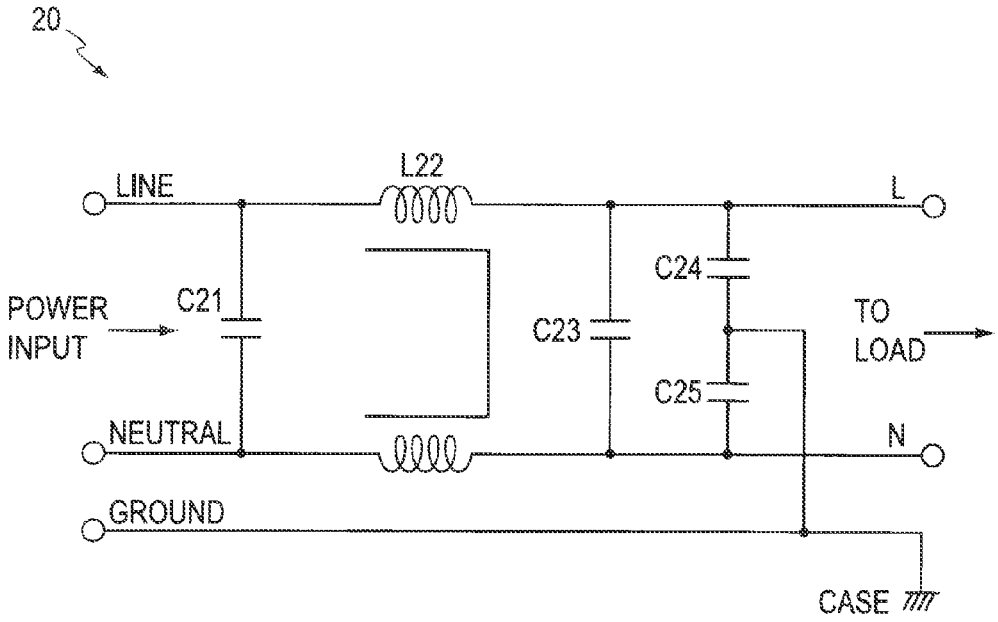
FIG. 4A shows a circuit diagram of an exemplary noise filter circuit 20.

FIG. 4A provides a circuit diagram of an exemplary noise filter circuit 20. As can be seen, the exemplary noise filter circuit 20 includes one or two common-mode inductors L22 and capacitors C21, C23, C24, and C25. In certain aspects, capacitors C21 or C23 may be omitted from the noise filter circuit 20. In certain aspects, other elements such as a thermistor may be employed.

The power supply circuit 30 outputs a regulated DC voltage to the lamp driver circuit 40. To do so, the power supply circuit 30 may have the primary function of converting the filtered AC power transmitted by the AC power source 10 through the noise filter circuit 20 into DC power via full-wave rectification. However, although the process of full-wave rectification can deliver uni-directional current, this uni-directional current is not produced at a constant voltage. Therefore, in certain aspects, an output filter capacitor is provided so as to function as a smoothing element and thereby produce a largely-steady DC voltage. In certain aspects, a regulator circuit is provided so as to control the voltage. In certain aspects, the power supply circuit 30 also includes a power factor correction circuit. The power factor of a circuit is defined as the ratio of active, real power P transmitted to the load of a circuit to the apparent power S (P/S) in the circuit. In purely resistive circuits, voltage and current waveforms are in phase; however, when reactive loads are present, such as with capacitors and inductors, energy stored in the loads creates a time difference between the current and voltage waveforms, thus rendering the waveforms out of phase and resulting in a lower power factor. A load with a low power factor draws more current than a load with a high power factor for the same amount of useful power transferred. Thus, it is often desirable to increase the power factor of an electrical system. In certain aspects, the addition of a power factor correction circuit to the power supply circuit 30 can increase the power factor of the segmented electronic are lamp ballast 1 from approximately 80% to approximately 99%.

Figure 4B:
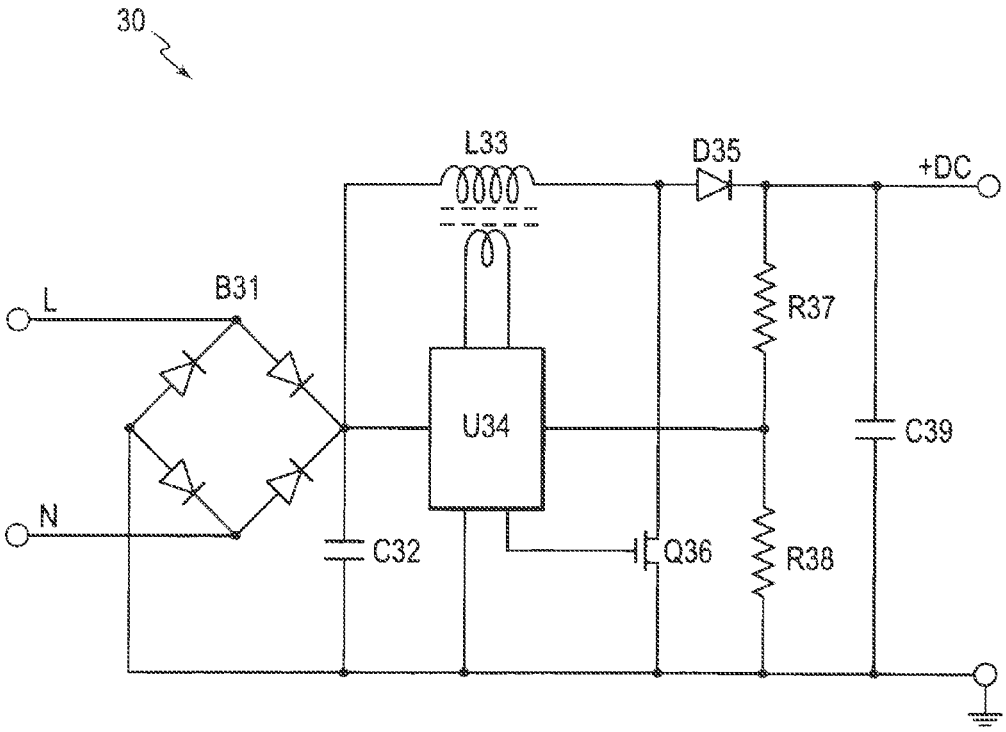
FIG. 4B shows a circuit diagram of an exemplary power supply circuit 30.

FIG. 4B provides a circuit diagram of an exemplary power supply circuit incorporating the above-described circuits. Integrated circuit controller U34 performs all the logic functions required to keep the output voltage stable and to maintain the power factor near unity. Diode bridge 131 rectifies the AC input and outputs a raw DC voltage to the capacitor C32. Transistor Q36, inductor L33, and diode D35 together comprise the power factor correction circuit. Resistors R37 and R38 detect the output voltage and send a sample to the controller U34, thereby allowing the controller U34 to exert control over the output voltage. Finally, capacitor C39 functions as the aforementioned smoothing capacitor, producing a largely-steady DC voltage from the ripple voltage output by the diode bridge B31.

The lamp driver circuit 40 outputs a lamp driving signal to the current control circuit 50. To do so, the lamp driver circuit 40 may have the primary function of generating a high-frequency square wave oscillating at a frequency of from 50 KHz-200 KHz. The frequency output from the lamp driver circuit 40 can vary depending on the running state of the lamp 70. For example, during the ignition operation, the lamp driver circuit 40 outputs a very high-frequency drive signal, which it then lowers during the running operation after ignition. In certain aspects, the lamp driver circuit 40 is configured to raise the output drive frequency so as to dim the lamp 70.

Figure 4C:
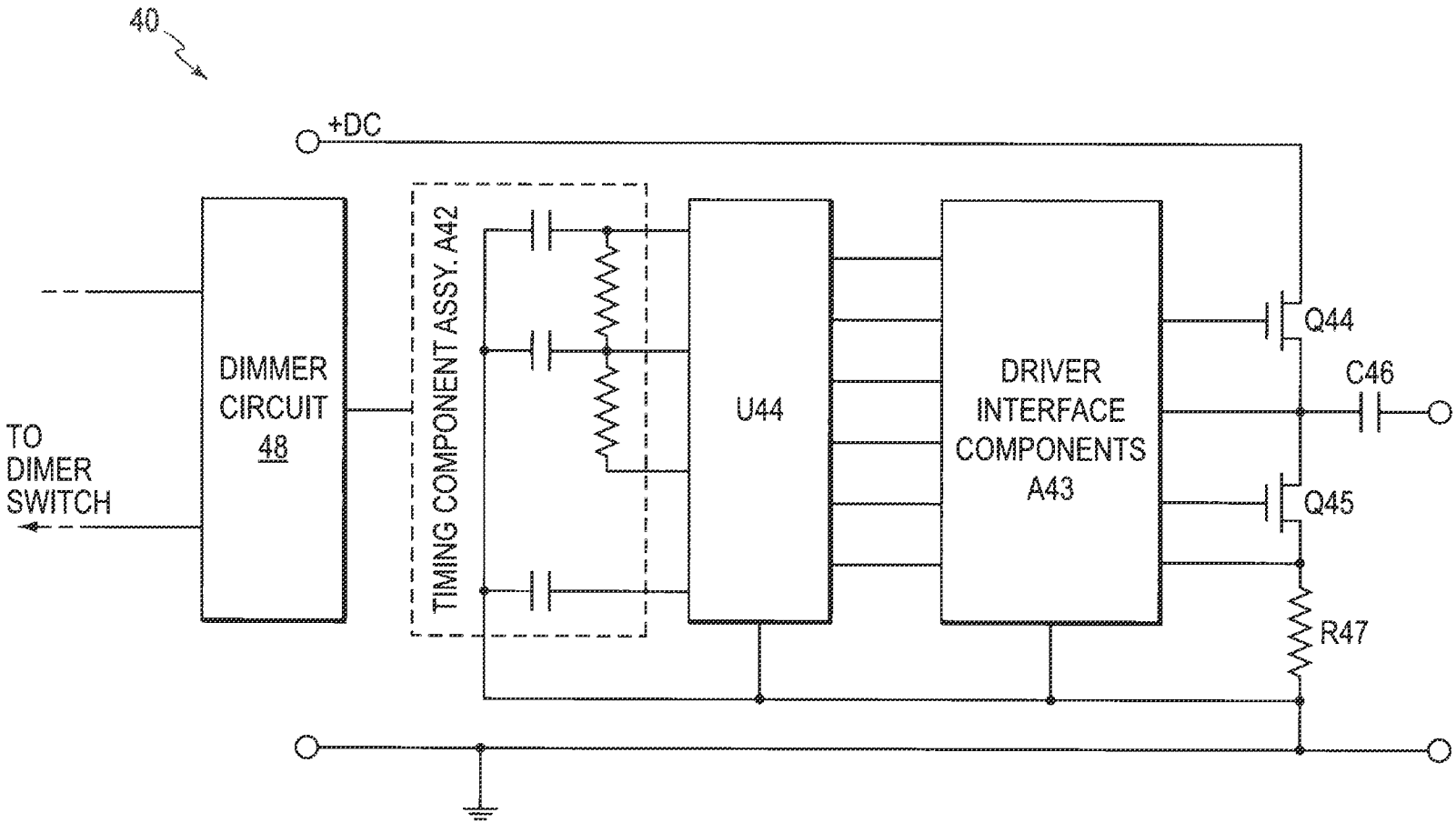
FIG. 4C shows a circuit diagram of an exemplary lamp driver circuit 40.

FIG. 4C provides a circuit diagram of an exemplary lamp driver circuit 40 performing the above-described functions. Integrated circuit controller U41 generates the aforementioned drive frequency. In certain aspects, the controller U41 is combined with the controller U34 of the power supply circuit 30, leaving the segmented electronic are lamp ballast 1 with but one controller, thereby gaining somewhat-improved functionality and decreased size. Power transistors Q44 and Q45, shown to be oriented in a half-bridge configuration, provide the high-frequency driving signal. Assembly A43 contains those circuits necessary to convert the controller outputs to proper gate driving signals. Resister R47 functions so as to monitor the current in power transistors Q44 and Q45 and to discontinue operation of the controller U41 if the detected current exceeds a predetermined threshold. Capacitor C46 removes the DC part of the output from the lamp driver circuit 40. Such an operation is necessary because, in certain aspects, the lamp 70 requires a pure AC drive signal to operate. Finally, dimmer circuit 48 detects inputs from a dimmer switch and relays such information to the assembly A42.

Figure 4D:
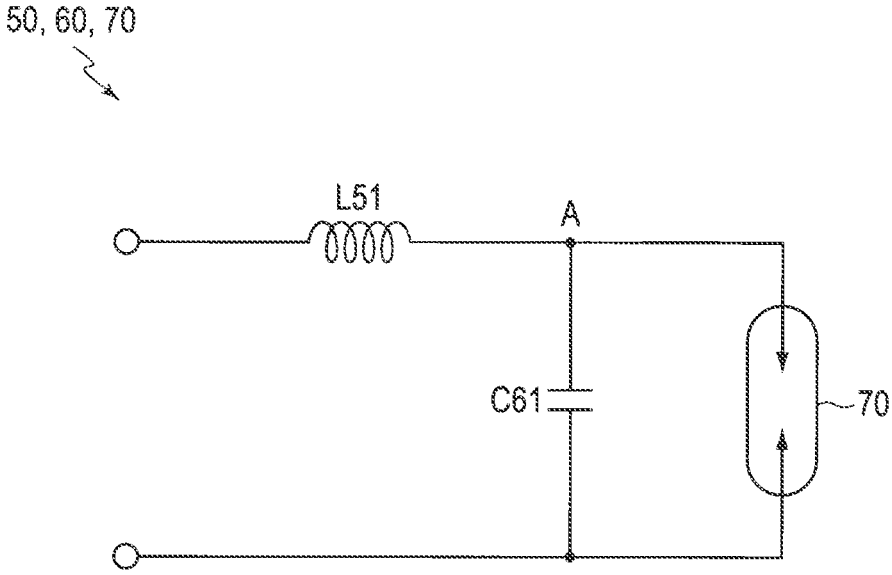
FIG. 4D shows a circuit diagram of an exemplary current control circuit 50, an exemplary ignition circuit 60, and an exemplary lamp 70.

The current control circuit 50 may have the primary function of limiting the current transmitted to the lamp 70. Moreover, the current control circuit 50 may have the secondary function of resonating with the ignition circuit 60 at the ignition frequency, thereby generating a very high voltage adequate to ignite the lamp 70. In certain aspects, such as that presented in FIG. 4D, the current control circuit 50 is a discrete inductor with a non-variable inductance value that is selected for use in a particular lighting application. In certain aspects, the current control circuit 50 is a programmable inductor including a plurality of selectable inductance values. In certain aspects, the current control circuit 50 is a plurality of inductors, each having a different inductance value to be paired with a corresponding lamp 70. In certain aspects, the ignition circuit 60 is simply a capacitor. With reference to FIG. 4D, inductor L51 serves as the current control circuit 50 and capacitor C61 serves as the ignition circuit 60. In the exemplary circuit, the current control circuit 50 and the ignition circuit 60 collectively form the claimed striker circuit 80.

The lamp 70 may be a high power are lamp in which light is produced by means of an electrical arc between electrodes housed within an arc tube. The tube of the arc lamp may be filled with both a gas that facilitates the arc's initial strike as well as metal salts which, once the arc is ignited, evaporate and thereby form a plasma. The lamp 70 can be rated for a certain wattage in the range of 50 W to 2000 W, the certain wattage of the lamp 70 matching that provided by the current control circuit 50. In certain aspects, the lamp 70 possesses a rating in the most common range of 250 W-400 W. In certain aspects, the lamp 70 possesses a less common rating of 150 W, 175 W or 320 W. In certain aspects, the electrodes of the lamp 70 are formed of tungsten. In certain aspects, the tube of the lamp 70 is formed of fused quartz. In certain aspects, the tube of the lamp 70 is formed of fused alumina. In certain aspects, the lamp 70 is a High Intensity Discharge ("HID") lamp. In certain aspects, the HID lamp 70 is a mercury vapor lamp. In certain aspects, the HID lamp 70 is a metal halide lamp. In certain aspects, the HID lamp 70 is a low-pressure sodium vapor lamp. In certain aspects, the HID lamp 70 is a high-pressure sodium vapor lamp.

Hereinafter, exemplary arrangements of the constituent circuits of the electronic arc lamp ballast 1 will be described with reference to the provided drawings.

Figure 2:
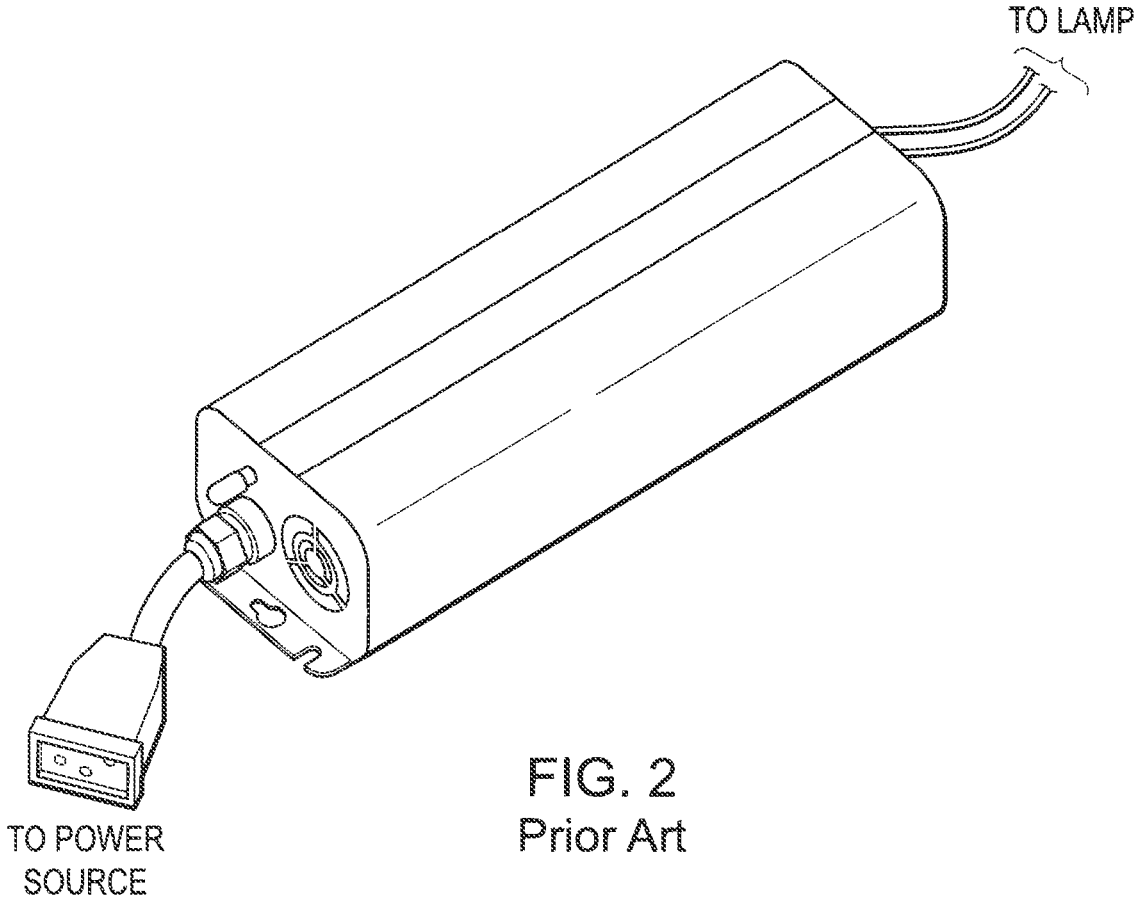
FIG. 2 Prior Art
FIG. 2 shows a perspective view of the housing of a related art electronic arc lamp ballast.
Figure 5:
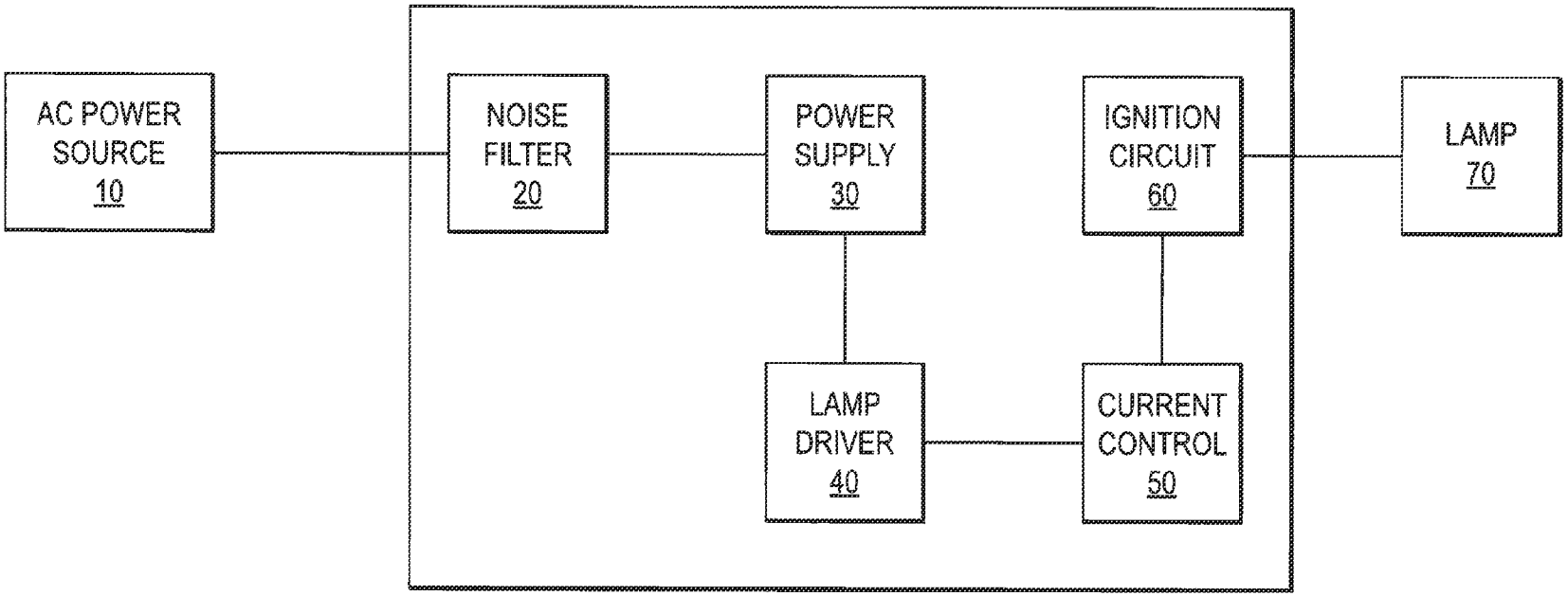
FIG. 5 shows an exemplary arrangement of the constituent circuits comprising a typical electronic arc lamp ballast.

FIG. 5 illustrates the arrangement of the above-described circuits in a typical electronic arc lamp ballast. As can be seen, the noise filter circuit 20, the power supply circuit 30, the lamp driver circuit 40, the current control circuit 50, and the ignition circuit 60 are all contained within a single housing. Such an electronic arc lamp ballast will typically have three protruding input wires connected to the AC power source 10, two protruding output wires connected to the lamp 70, and in certain aspects, two additional protruding wires configured to provide for dimmer control. However, this particular arrangement makes drop-in replacement of a pre-existing magnetic ballast within an HID light fixture troublesome because the inductor-capacitor network typically comprising the current control circuit 50 and the igniter circuit 60 (striker circuit 80) is sizable, and the typical HID light fixture lacks sufficient space within to accommodate a single housing containing all circuits of the typical electronic arc lamp ballast. Additionally, because the typical electronic arc lamp ballast is unable to utilize the mounting apparatus of the transformer element of the pre-existing magnetic ballast, heat build-up of the typical electronic arc lamp ballast becomes problematic. Hence, the current need to install the typical electronic arc lamp ballast exterior to a pre-existing HID light fixture. FIG. 2 once again provides a perspective view of the housing of the typical electronic are lamp ballast.

Figure 6A:
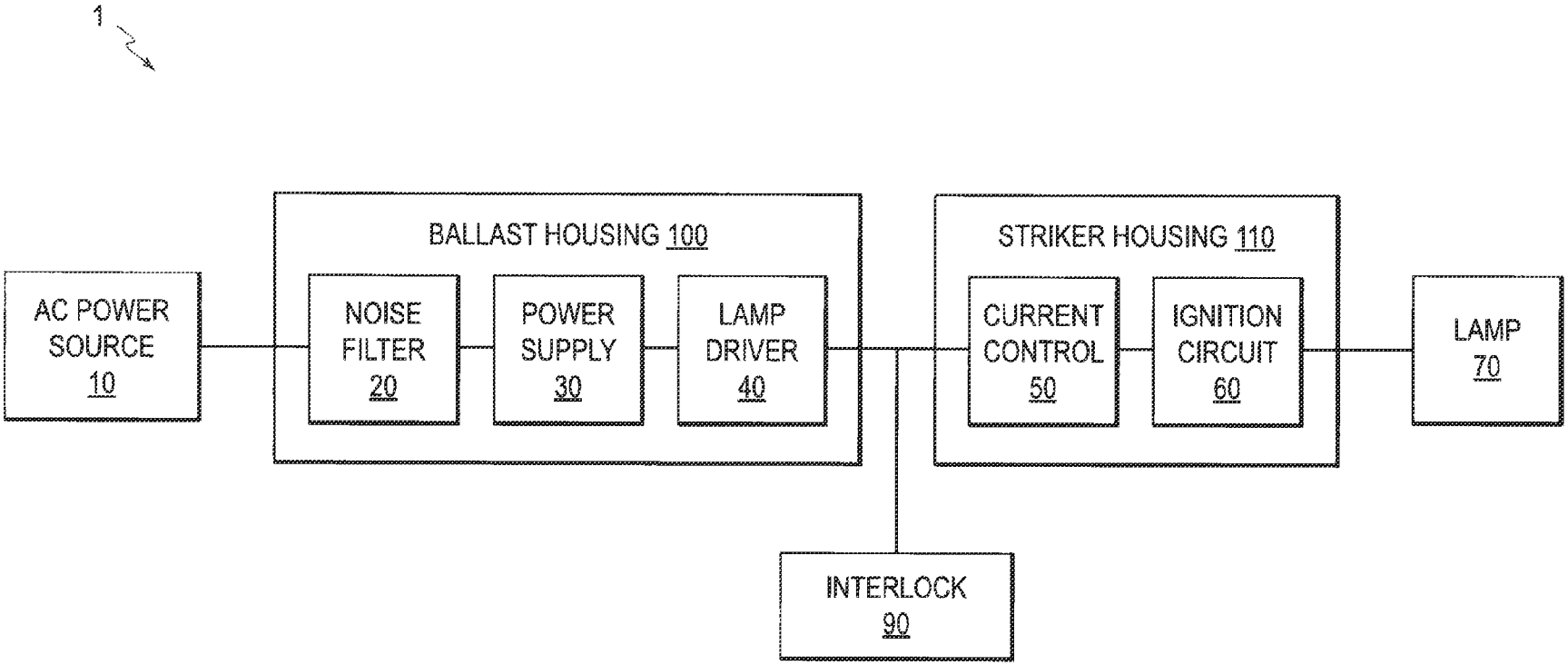
FIG. 6A shows an exemplary arrangement of the constituent circuits comprising the segmented electronic arc lamp ballast 1.

Conversely, FIG. 6A illustrates an arrangement of the constituent circuits comprising the electronic arc lamp ballast 1. As can be seen, the noise filter circuit 20, the power supply circuit 30, and the lamp driver circuit 40 can be situated within a first housing 100, referred to as a ballast housing. Furthermore, the current control circuit 50 and the ignition circuit 60, the circuits that may comprise the claimed striker circuit 80, can be situated within a second housing 110, referred to as a striker housing. A plurality of external wires can protrude from the ballast housing 100 and from the striker housing 110. In certain aspects, the segmented electronic are lamp ballast 1 has three external connecting wires protruding from the ballast housing 100, thus connecting the noise filter circuit 20 to the AC power source 10; has external wiring connecting the lamp driver circuit 40 of the ballast housing 100 to the current control circuit 50 of the striker housing 110;

and has two output wires protruding from the striker housing 110, thus connecting the ignition circuit 60 to the lamp 70. By removing the sizable current control circuit 50 and the ignition circuit 60 from the ballast housing 100, the ballast housing 100 can become small enough to fit within the space of the typical HID light fixture occupied by the transformer of the pre-existing magnetic ballast, described in detail below. Additionally, the striker housing 110, including both the current control circuit 50 and the ignition circuit 60, can be small enough to fit within the space of the typical HID light fixture occupied by the filter capacitor of the pre-existing magnetic ballast, also described in detail below.

Figure 6B:
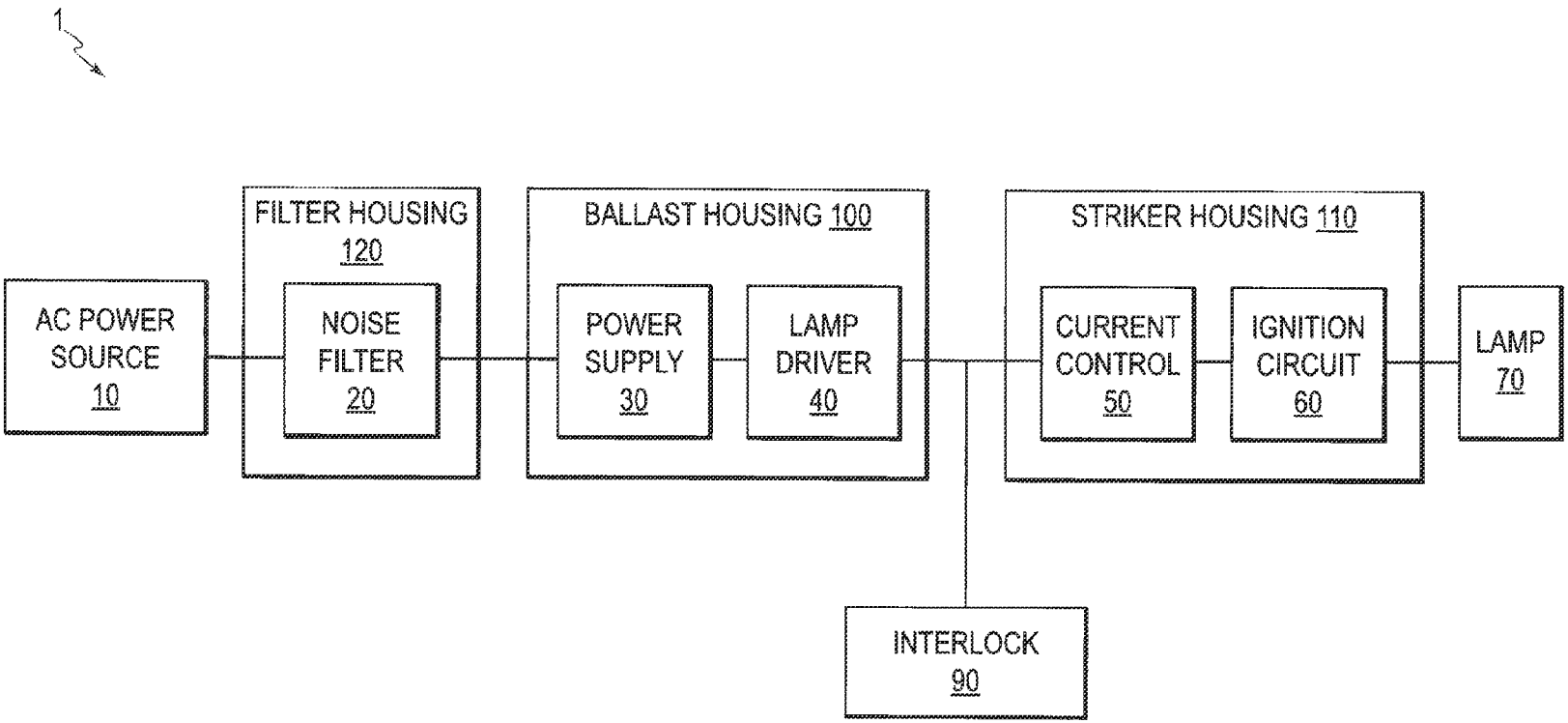
FIG. 6B shows an exemplary arrangement of the constituent circuits comprising the segmented electronic arc lamp ballast 1.

Another exemplary arrangement of the constituent circuits comprising the segmented electronic arc lamp ballast 1 is illustrated in FIG. 6B. In this embodiment, the segmented electronic arc lamp ballast 1 includes, in addition to the aforementioned first, ballast housing 100 and the second, striker housing 110, a third housing 120. As above, the ballast housing 100 includes the power supply circuit 30 and the lamp driver circuit 40. The striker housing 110, also similar to the previous embodiment, includes the current control circuit 50 and the ignition circuit 60. However, in this embodiment, the noise filter circuit 20 has been moved to the third housing 120, referred to as a filter housing. A plurality of external wires protrude from the ballast housing 100, the striker housing 110, and the filter housing 120. In certain aspects, three external connecting wires protrude from the filter housing 120 so as to electrically connect the AC power source 10 to the noise filter circuit 20 of the filter housing 120; external wiring connects the filter circuit 20 of the filter housing 120 to the power supply circuit 30 of the ballast housing 100; external wiring connects the lamp driver circuit 40 of the ballast housing 100 to the current control circuit 50 of the striker housing 110; and two output wires once again connect the ignition circuit 60 of the striker housing 110 to the lamp 70. By placing the noise filter circuit 20 within a separate housing, the physical size of the ballast housing 100 can be further reduced, thereby ensuring that it may be placed within the space of the typical HID light fixture occupied by the transformer of the pre-existing magnetic ballast. Additionally, the filter housing 120 can be small enough to be placed in the space of the typical HID light fixture occupied by the igniter of the pre-existing magnetic ballast, also described in detail below.

With further respect to FIGS. 6A and 613, an interlock element 90 can be provided. The interlock element 90 may have the primary function of determining whether the current control circuit 50 and the ignition circuit 60 are connected to the remaining circuits of the segmented electronic are lamp ballast 1. The interlock element 90 may also have the secondary function of preventing activation of the lamp driver circuit 40 if the current control circuit 50 and/or the ignition circuit 60 are disconnected. Such an element is desirable for at least two reasons. First, if the circuits of the ballast housing 100 are activated without being connected to the current control circuit 50 and the ignition circuit 60 of the striker housing 110, potentially lethal voltages will be present at the output wiring protruding from the ballast housing 100. Second, the lamp driver circuit 40 will be damaged if it runs for a sustained period of time without the added load of the current control circuit 50 and the ignition circuit 60.

In certain aspects, the interlock element 90 constitutes a power jumper included in the external wiring connecting the lamp driver circuit 40 of the ballast housing 100 to the current control circuit 50 of the striker housing 110. Such a technique can be included because it is simple, reliable, and cost-effective. In certain aspects, the interlock element 90 constitutes a switch built into the external wiring connecting the lamp driver circuit 40 of the ballast housing 100 to the current control circuit 50 of the striker housing 110. In certain aspects, the interlock element 90 constitutes a micro-switch configured to detect the physical presence of the striker housing 110 within the housing of the typical HID light fixture. In certain aspects, the interlock element 90 constitutes a separate circuit within the ballast housing 100 configured to detect the presence of the current control circuit 50) and/or the ignition circuit 60 within the striker housing 110 and further configured to deactivate the circuits of the ballast housing 100 if the circuits of the striker housing 110 are disconnected. Alternatively, the interlock element 90 may include any combination of the above embodiments.

Figure 7A:
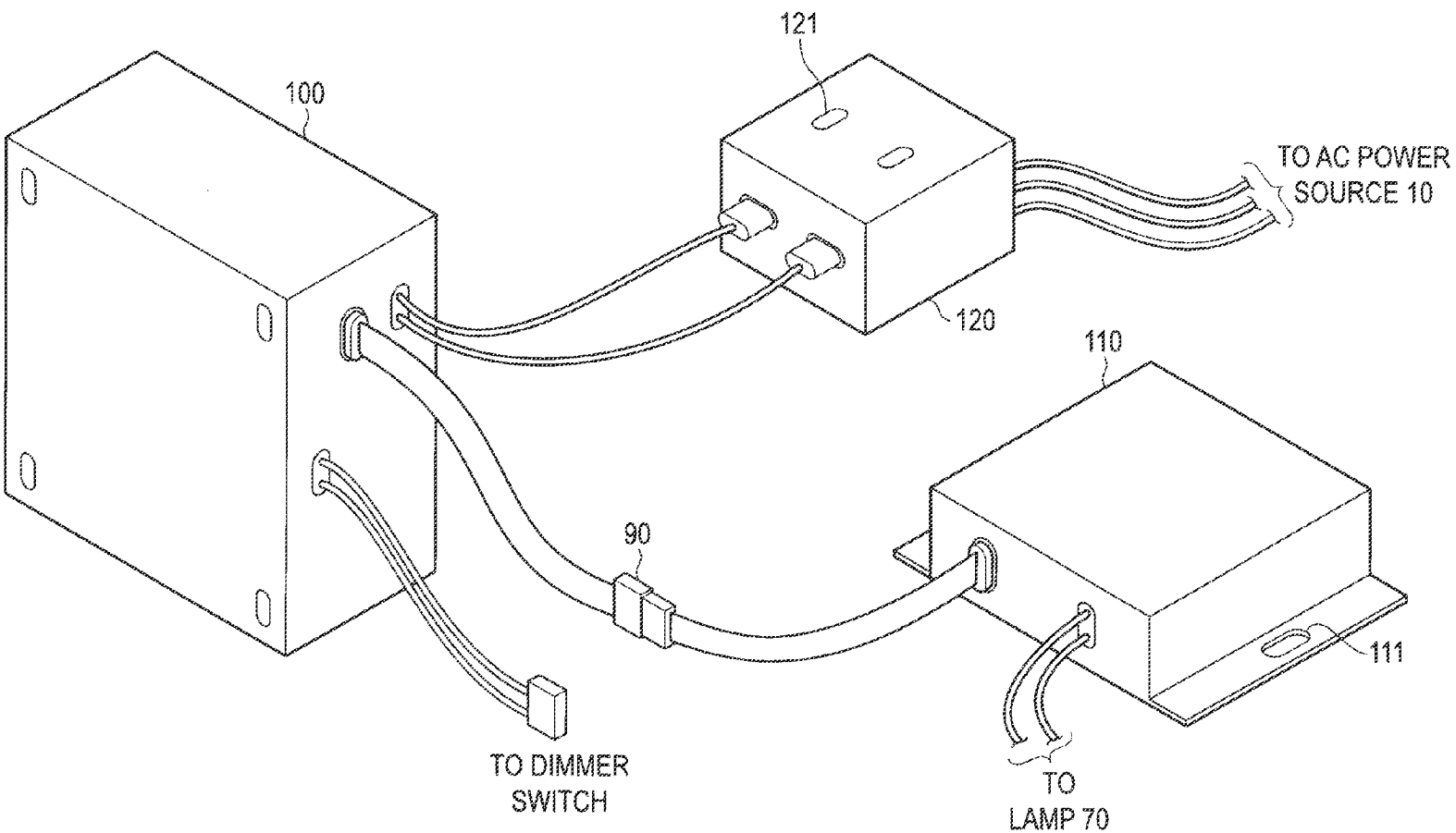
FIG. 7A shows a perspective view of an exemplary segmented electronic arc lamp ballast 1.

FIG. 7A provides a perspective view of the exemplary embodiment of the segmented electronic are lamp ballast 1 divided into the filter housing 120, the ballast housing 100, and the striker housing 110. In certain aspects, the filter housing 120, the ballast housing 100, and the striker housing 110 are formed out of stamped or cast aluminum. Aluminum is desirable because it is light weight, easily machined, and has adequate electrical conductivity and heat conductivity. In certain aspects, the filter housing 120, the ballast housing 100, and the striker housing 110 are formed out of stamped or cast steel, for some forms of steel have a better magnetic shielding capability than aluminum. In certain aspects, the filter housing 120 is formed out of stamped or cast steel, and the ballast housing 100 and the striker housing 110 are formed out of stamped or cast aluminum.

Figure 7B:
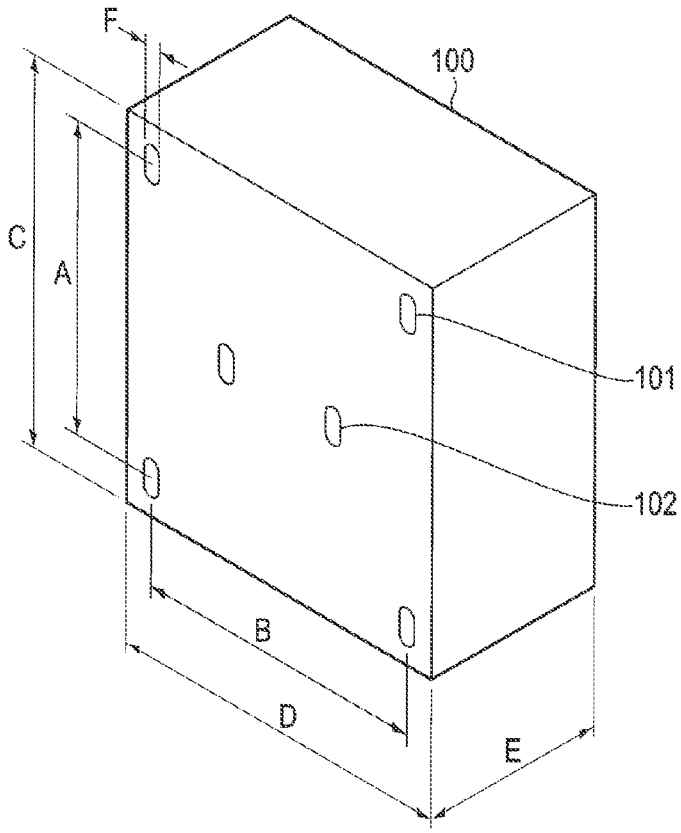
FIG. 7B shows a diagram of relevant dimensions of an exemplary ballast housing 100 of the segmented electronic arc lamp ballast 1.

Of particular import are the dimensions of the ballast housing 100 indicated in FIG. 7B. As previously stated, by removing the current control circuit 50 and the ignition circuit 60, the ballast housing 100 can become a size small enough to be placed in the space of the typical HID light fixture occupied by the transformer of the pre-existing magnetic ballast. Thus, in certain aspects, the outer height C of the ballast housing 100 is identical to the corresponding dimension of the transformer of the pre-existing magnetic ballast. In certain aspects, the outer width D of the ballast housing 100 is identical to the corresponding dimension of the transformer of the pre-existing magnetic ballast. In certain aspects, the depth E of the ballast housing 100 is preferably less than the diameter of the coil of the transformer of the pre-existing magnetic ballast. In certain aspects, both the outer height C and the outer width D of the ballast housing 100 are identical to the corresponding dimensions of the transformer of the pre-existing magnetic, and the depth E of the ballast housing 100 is less than the diameter of the coil of the transformer of the pre-existing magnetic ballast.

Moreover, as can also be seen in FIG. 7B, the ballast housing 100 can be equipped with thru-holes 101 forming a rectangle having a height A and a width B. In certain aspects, each thru-hole 101 has a diameter F corresponding to thru-holes on the transformer of the pre-existing magnetic ballast. In certain aspects, the hole-spacing height A is identical to a corresponding dimension of the transformer of the pre-existing magnetic ballast. In certain aspects, the hole-spacing width B is identical to a corresponding dimension of the transformer of the pre-existing magnetic ballast. In certain aspects, both the height A and the width B are identical to the corresponding dimensions of the transformer of the pre-existing magnetic ballast. Exemplary values of the hole-spacing height A, hole-spacing width B, outer height C, outer width D, depth E, and diameter F will be provided in the discussion of the transformer of the pre-existing magnetic ballast below.

Additionally, as also shown in shown in FIG. 7B, one of the two faces of the ballast housing 100 having height C and width D can be configured to incorporate threaded holes 102.

The spacing of these threaded holes 102 corresponds to holes 121 provided on a surface of the filter housing 120, as illustrated in FIG. 7A. By providing such holes 121, the filter housing 120 may be fixed to the ballast housing 100 by screws or other types of fasteners. This arrangement enables the ballast housing 100 and the filter housing 120 to both be properly secured in the space of the typical HID light fixture occupied by the transformer of the pre-existing magnetic ballast. In certain aspects, other attachment mechanisms may be utilized to fix the filter housing 120 to the ballast housing 100. In certain aspects, threaded holes may be provided on the ballast housing 100 so as to fix the striker housing 110 to the ballast housing 100 via corresponding holes 111 on the striker housing 110.

Hereinafter, exemplary methods of drop-in replacement of a pre-existing magnetic ballast installed within a light fixture for a high power are lamp, such as a High Intensity Discharge ("HID") lamp, with the segmented electronic arc lamp ballast 1 will be described with reference to the provided drawings.

Figure 8A:
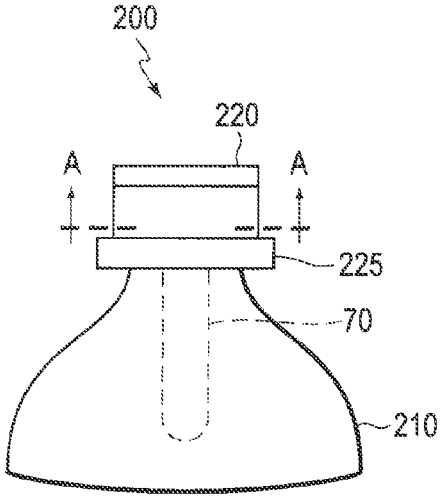
FIG. 8A shows a perspective view of a typical HID light fixture 200.

FIG. 8A illustrates a typical light fixture 200 for the lamp 70. Notably, this light fixture 200 includes a reflector 210 and a housing 220 to which the lamp 70 is attached. The housing 220 further includes a cover 225 allowing access to its interior. Such a light fixture 200 is often used for commercial and public implementations such as in warehouses, gymnasiums and other large indoor areas. In certain aspects, the light fixture 200 is configured to accommodate HID lamps in the most common ratings of 175 W, 250 W, and 400 W, although other wattages are possible. Variations of this application would also work with any lamp in the range of 150 W to 2000 W. It is to be understood that the form of the light fixture 200 illustrated in FIG. 8A is merely exemplary and is not intended to limit the scope of this application. For examples, other light fixtures designed for interior use have substantially different internal and external structures, yet possess the same constituent parts. Additionally, fixtures having different external shapes are often used for the lighting of roadways, parking areas, arenas, pools, and other large outdoor facilities.

Figure 8B:
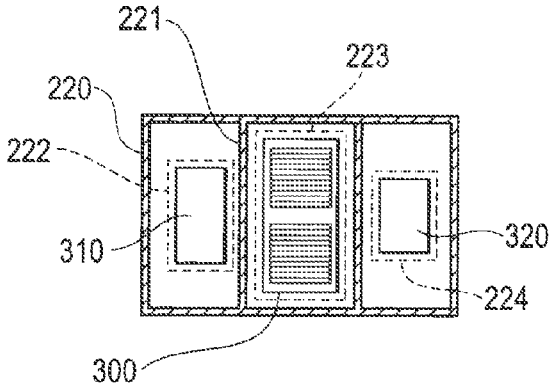
FIG. 8B shows an interior cut-away of the housing 220 of the typical HID light fixture 200.

FIG. 8B depicts the interior compartment formed by the housing 220 of the light fixture 200 viewed from a perspective A-A in FIG. 8A. As can be seen, the interior compartment can contain a magnetic ballast composed of three primary elements: a transformer 300, a large filter capacitor 310, and an igniter 320. The structure and function of these particular elements of a magnetic ballast are well-known to those skilled in the art and thus only a brief description of each element will be provided.

Figure 9A:
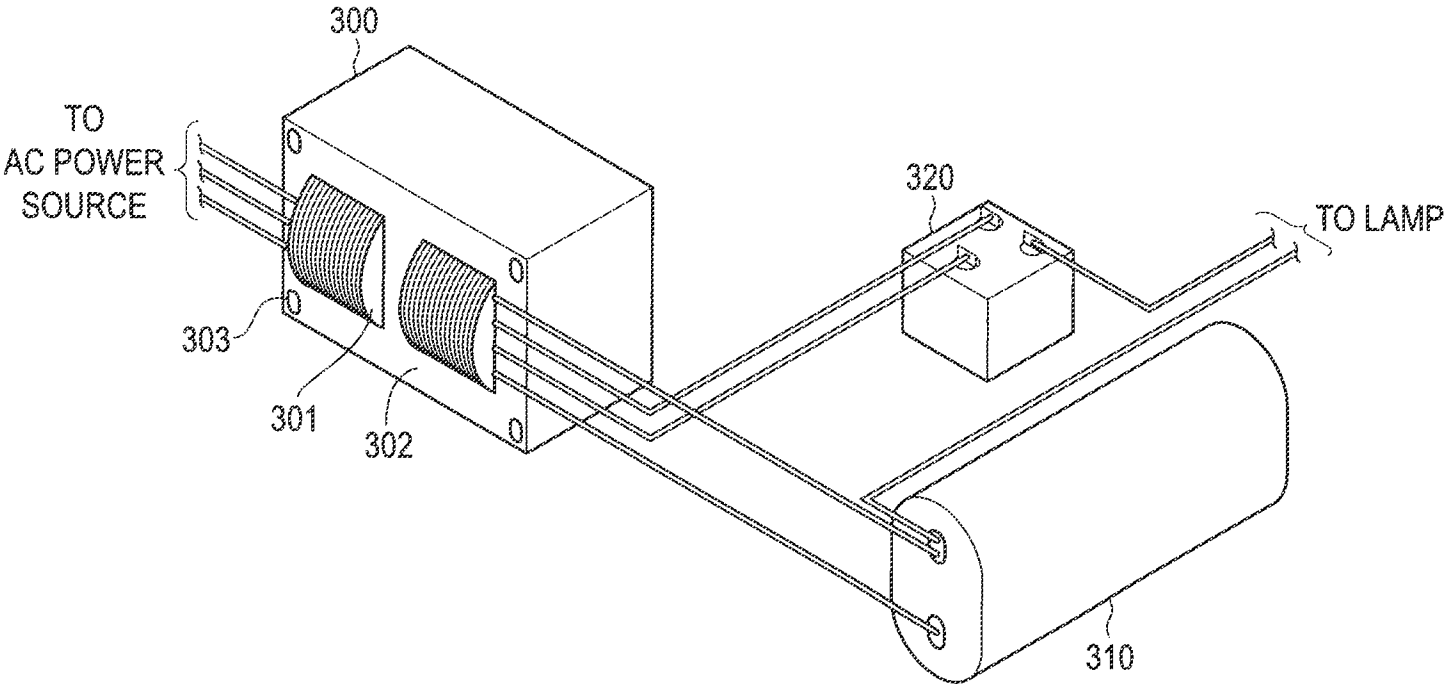
FIG. 9A shows a perspective view of the pre-existing magnetic ballast.

With reference to FIG. 9A, which provides a perspective view of the entire pre-existing magnetic ballast, the transformer 300 may have the primary purpose of providing proper current to the lamp 70 once the lamp is started and an are is successfully established. Accordingly, the transformer 300 both changes an input AC line voltage to that required by the lamp 70 and also limits the flow of current to the lamp 70. Furthermore, in certain aspects, such as those utilizing "probe start" type lamps, the transformer 300 may provide the proper starting voltage to strike as well as maintain the are within the lamp 70. Newer "pulse start" lamps typically require an igniter, discussed in detail below. In the present example, the transformer 300 is of the core and coil type, consisting of one, two or three metallic coils 301 on a core 302 of electrical-grade steel laminations. In certain aspects, the metallic coils are copper. The core and coil transformer is the most basic and popular manner of utilizing a magnetic ballast in today's industrial applications, and it forms the operative nucleus of all other configurations such as potted core and coil, f-can, indoor enclosed, outdoor weatherproof, and post line magnetic ballasts.

Figure 9B:
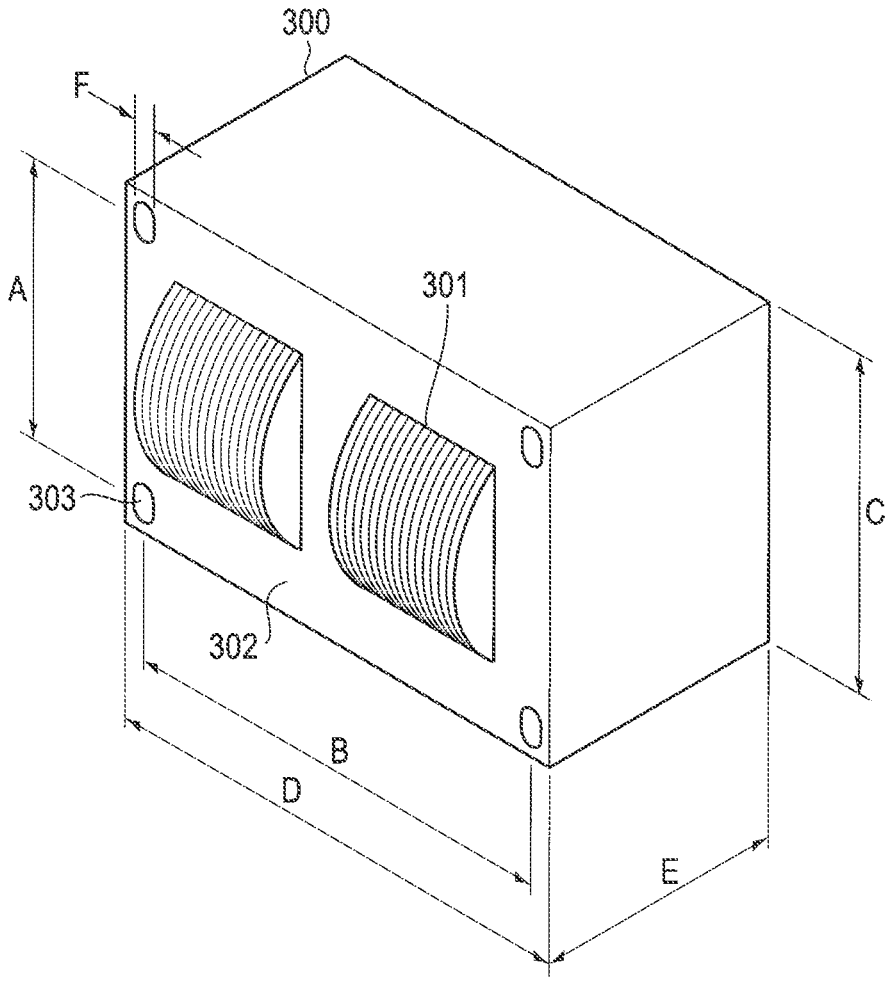
FIG. 9B shows a diagram of relevant dimensions of the transformer 300 of the pre-existing magnetic ballast.

The exemplary transformer 300 may share physical dimensions A, B, C, D, E and F with other core and coil transformers in the 250 W-400 W range. An observant reader will recall that any number of these dimensions may also be shared by the ballast housing 100 of the segmented electronic arc lamp ballast 1. Referencing FIG. 9B, the outer height C of the transformer 300 ranges from approximately 2.5 to 4.5 inches; the outer width D ranges from approximately 3.5 to 5 inches; the height A ranges from approximately 2 to 4 inches; and the width B ranges from approximately 3 to 4.5 inches. In certain aspects, the outer height C and the outer width D of the transformer 300 are respectively 4.25 and 4.75 inches; the height A is 3.875 inches and the width B is 4.375 inches; the depth E ranges from 3.0 to 4.3 inches; and the diameter F of thru-holes 303 is 0.19 inches, sufficient to accommodate a #10 thru-bolt. In certain aspects, the outer height C and the outer width D of the transformer 300 are respectively 2.8125 and 3.9375 inches; the height A is 2.4375 inches and the width B is 3.5 inches; the depth E is 4.2 inches; and the diameter F of thru-holes 303 is 0.19 inches, sufficient to accommodate a #10 thru-bolt. In certain aspects, the outer height C and the outer width D of the transformer 300 are respectively 3.75 and 4.5 inches; the height A is 3.3125 inches and the width B is 4.0625 inches; the depth E ranges from 3.2 to 4.0 inches; and the diameter F of thr-holes 303 is 0.138 inches, sufficient to accommodate a #6 thru-bolt.

The large filter capacitor 310 may be included to improve the power factor of the transformer 300. As previously discussed, the power factor of a circuit is defined as the ratio of active, real power P transmitted to the load of a circuit to the apparent power S (P/S) in the circuit. A load with a low power factor draws more current than a load with a high power factor for the same amount of useful power transferred. Thus, it is often desirable to increase the power factor of an electrical system. In a typical magnetic ballast 300 for an HID lamp, the addition of a large filter capacitor 310 can correct the inherently normal power factor of a typical transformer from approximately 50% to approximately 90%. In certain aspects, the filter capacitor is oil-filled. In certain aspects, the filter capacitor is dry, typically requiring but half the space utilized by oil-filled filter capacitors.

The igniter 320 may be included as part of the magnetic ballast when utilizing I-D arc lamps of certain types, such as high pressure sodium, low wattage metal halide, and pulse start medal halide, which do not have a starter probe electrode. For these lamp types, which require a higher pulse voltage than that transmitted solely by the transformer 300 in order to initiate the lamp arc, the igniter may provide a pulse of at least 2.5 KV. This pulse discontinues once the lamp has started.

Turning once again to FIG. 8B, within the interior compartment of the housing 220 can be formed a series of partitioning walls 221 that divide the internal compartment into several distinct sections. In the leftmost section from the reader's perspective, the large filter capacitor 310 of the pre-existing magnetic ballast can be fixed to the housing 220 in a filter capacitor mounting position 222. In the centermost section, the transformer 300 of the pre-existing magnetic ballast can be fixed to the housing 220 in a transformer mounting position 223. And in the rightmost section, the igniter 320 of the magnetic ballast can be fixed to the housing 220 in an igniter mounting position 224. It is to be understood that, in certain aspects, the mounting positions of the respective elements need not be in this particular arrangement. It is to be further understood that, in certain aspects, one or both of the partitioning walls 221 may not be present in the housing 220. Thus, in certain aspects, the housing 220 may be divided into two partitions or even a single partition.

The manner of mounting the filter capacitor 310 to the filter capacitor mounting position 222 or of mounting the igniter 320 to the igniter mounting position 224 is not particularly limited. In certain aspects, both the filter capacitor 310 and the igniter 320 are each secured to the housing 220 with a single screw. In certain aspects, the igniter 320 includes a thru-hole through which such a screw is placed. In certain aspects, the filter capacitor 310 possesses a metal strap with holes in both ends of the strap through which such a screw is placed. In certain aspects, the filter capacitor 310 and the igniter 320 are simply held against the housing 220 using a piece of foam rubber. In certain aspects, a bracket is provided so as to hold the filter capacitor 310 in a specific location against the housing 220. In certain aspects, an adapter bracket is needed (usually for accessibility reasons) for the igniter 320, the adapter bracket accepting a first screw for the igniter 320 and a second screw so as to attach both the adapter bracket and the igniter 320 to the housing 220.

Figure 8C:
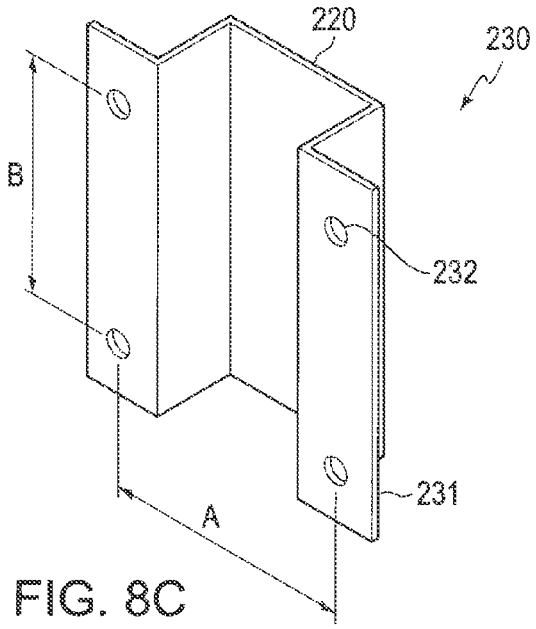
FIG. 8D shows an isometric view of a second embodiment of the transformer mounting apparatus 230.
FIG. 8E shows an isometric view of a third embodiment of the transformer mounting apparatus 230.
FIG. 8F shows an interior cut-away of the housing 220 of the typical HID light fixture 200 with the pre-existing magnetic ballast removed.
Figure 8D:
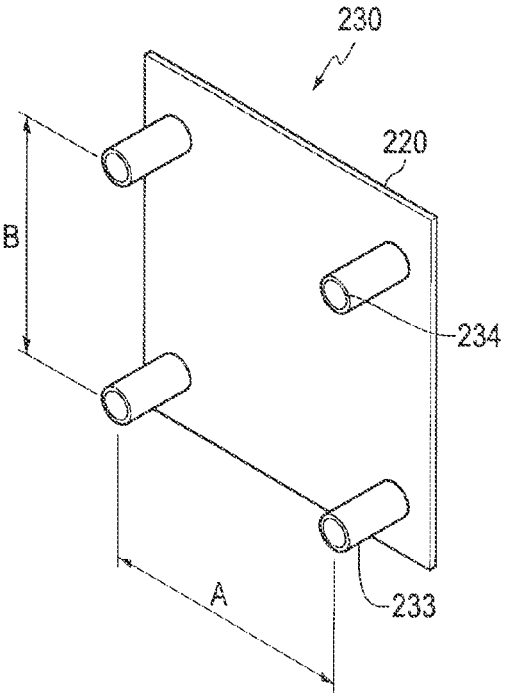
Figure 8E:
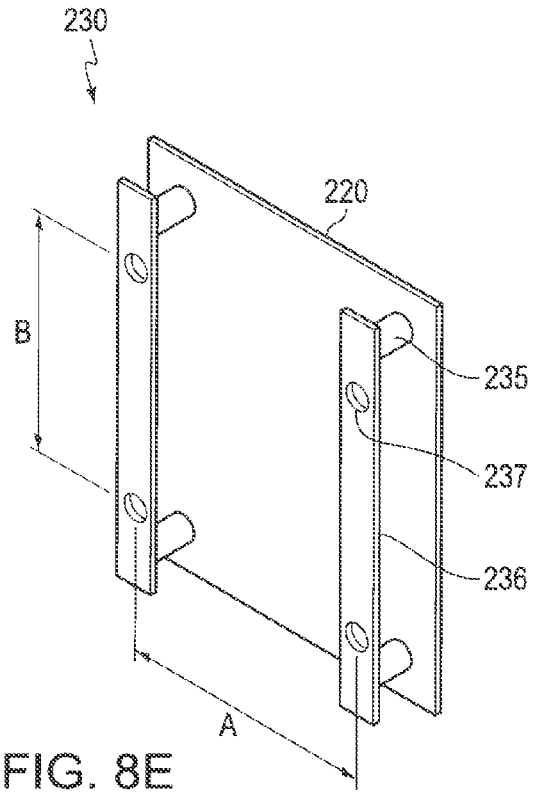

FIGS. 8C-8E provide isometric views of a transformer mounting apparatus 230 within the transformer mounting position 223 with the transformer 300 of the pre-existing magnetic ballast removed. By using the transformer mounting apparatus 230, not only is the transformer 300 secured to the housing 220, but also heat generated by the transformer 300 is directed away from the transformer 300 and into the housing 220.

In certain aspects, illustrated in FIG. 8C, support ledges 231 are extended toward the reader from the far surface of the housing 220. Within the support ledges 231 can be provided mounting holes 232 that correspond to the thru-holes 303 of the transformer 300 by forming a rectangle of dimensions A and B. By extending a thru-bolt through the holes 303 of the transformer 300 and by securing the thru-bolt via the mounting holes 232, the transformer 300 may be securely fastened to the housing 220 in the transformer mounting position 223. Additionally, because the support ledges 231 are raised a sufficient distance with respect to the far surface of the housing 220, adequate space is provided between the support ledges 231 for the coil 301 of the transformer 300 to reside.

In certain aspects, illustrated in FIG. 8D, support columns 233, each column possessing a mounting hole 234, extend toward the reader from the far surface of the housing 220. As with the mounting holes 232 of the previous embodiment, the holes 234 of the support columns 233 correspond to the holes 303 of the transformer 300 by forming a rectangle of dimensions A and B. Once again, by extending a thru-bolt through the holes 303 of the transformer 300 and by securing the thru-bolt via the mounting holes 234, the transformer 300 may be securely fastened to the housing 220 in the transformer mounting position 223. Additionally, because the support columns 233 are raised a sufficient distance with respect to the far surface of the housing 220, adequate space is provided between the support columns 233 for the coil 301 of the transformer 300 to reside.

In certain aspects, illustrated in FIG. 8E, support columns 235 extend toward the reader from the far surface of the housing 220. However, unlike the embodiment presented in FIG. 5D, the placement of the support columns 235 may not correspond to the placement of the thru-holes 303 of the transformer 300. Accordingly, mounting bracket 236, possessing mounting holes 237 corresponding to the thru-holes 303 of the he transformer 300 by forming a rectangle of dimensions A and B, can be fixed to the support columns 235. Once again, by extending a thru-bolt through the holes 303 of the transformer 300 and by securing the thru-bolt via the mounting holes 237, the transformer 300 may be securely fastened to the housing 220 in the transformer mounting position 223. Additionally, because the support columns 235 are raised a sufficient distance with respect to the far surface of the housing 220, adequate space is provided between the support columns 235 and the mounting bracket 236 for the coil 301 of the transformer 300 to reside. Furthermore, by using the mounting bracket 236 to connect to the support column 235, the transformer mounting apparatus 230 can accommodate different transformers 300 of varying dimensions.

In certain aspects, the transformer mounting apparatus 230 consists of an "interference fit" formed by the sandwiching of the transformer 300 between the far surface of the housing 220 and the housing cover 225. To securely hold the transformer 300, the distance between the far surface of the housing 220 and the housing cover 225 may be slightly less than outer height C or outer width D of the transformer 300. In this matter, the transformer 300 may be installed within the transformer mounting position 223 rapidly and without additional tools or mounting hardware.

Figure 8F:
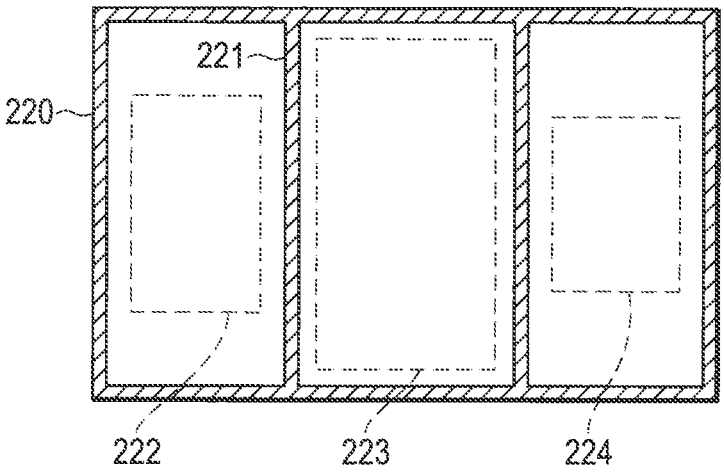

FIG. 8F depicts the internal compartment of the light fixture 200 from the perspective A-A in FIG. 8A after the removal of the filter capacitor 310, the transformer 300, and the igniter 320. As can be seen, a void may now be present in the filter capacitor mounting position 222 in the leftmost section of the internal compartment; a void may now be present in the transformer mounting position 223 in the centermost section of the internal compartment; and a void may now be present in the igniter mounting position 224 in the rightmost section of the internal compartment.

Figure 8G:
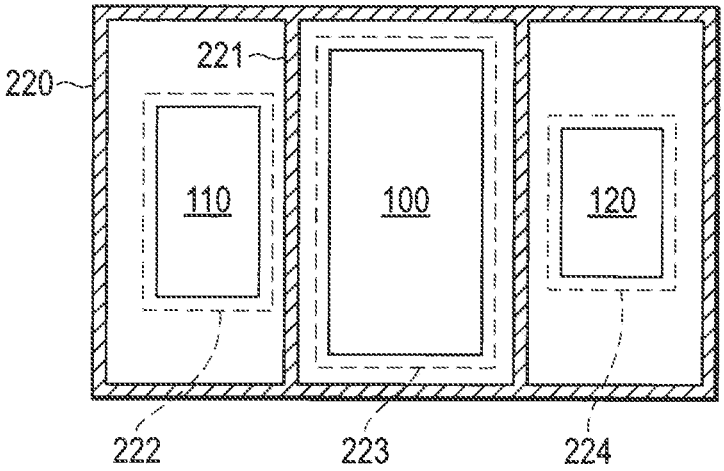

FIG. 8G depicts the internal compartment of the light fixture 200 from the perspective A-A in FIG. 8A after insertion of the segmented electronic arc lamp ballast 1. In certain aspects, as shown in FIG. 80, the striker housing 110, comparable in size to the removed filter capacitor 310, now resides in the filter capacitor mounting position 222 in the leftmost section of the internal compartment formed by the housing 220; the ballast housing 100, comparable in size to the removed transformer 300, now resides in the transformer mounting position 223 in the centermost section of the internal compartment; and the filter housing 120, comparable in size to the removed igniter 320, now resides in the igniter mounting position 224 in the rightmost section of the internal compartment. In certain aspects, both the filter housing 120 and the ballast housing 100 may be mounted in the transformer mounting position 223 in the centermost section of the internal compartment. In certain aspects, both the filter housing 120 and the striker housing 110 may be mounting in the filter capacitor mounting position 222. In certain aspects, given sufficient space within the housing 220, the ballast housing 100, the striker housing 110, and the filter housing 120 may all be mounted in the transformer mounting position 223. In certain aspects, because of at least one of the common dimensions A, B, C, D, E, and F of the transformer 300 and of the ballast housing 100, the ballast housing 100 is secured to the housing 220 using the transformer mounting apparatus 230. In the above manners, the segmented electronic arc lamp ballast 1 may be mounted within the space of the housing 220 previously utilized for the pre-existing magnetic ballast without substantial changes to the structure of the housing 220 or to the surrounding environment. Additionally, because the ballast housing 100 may be fixed to the transformer mounting apparatus 230, heat generated by the ballast housing 100 may be dissipated in the same manner as was heat generated by the transformer 300 of the pre-existing magnetic ballast.

| Numeral | Element |
|---|---|
| 1 | Segmented Electronic Ballast |
| 10 | AC Power Source |
| 20 | Noise Filter Circuit |
| 21 | 1st Noise Filter Capacitor |
| 22 | Noise Filter Inductor |
| 23 | 2nd Noise Filter Capacitor |
| 24 | 3rd Noise Filter Capacitor |
| 25 | 4th Noise Filter Capacitor |
| 30 | Power Supply Circuit |
| 31 | Power Supply Diode Bridge |
| 32 | 1st Power Supply Capacitor |
| 33 | Power Supply Inductor |
| 34 | Integrated Circuit Controller |
| 35 | Power Supply Diode |
| 36 | Power Supply Transistor |
| 37 | 1st Power Supply Resister |
| 38 | 2nd Power Supply Resister |
| 39 | 2nd Power Supply Capacitor |
| 40 | Lamp Driver Circuit |
| 41 | Integrated Circuit Controller |
| 42 | 1st Lamp Driver Assembly |
| 43 | 2nd Lamp Driver Assembly |
| 44 | 1st Lamp Driver Transistor |
| 45 | 2nd Lamp Driver Transistor |
| 46 | Lamp Driver Capacitor |
| 47 | Lamp Driver Resister |
| 48 | Dimmer Circuit |
| 50 | Current Control Circuit |
| 51 | Current Control Inductor |
| 60 | Ignition Circuit |
| 61 | Ignition Capacitor |
| 70 | Lamp |
| 80 | Striker Circuit |
| 90 | Interlock Element |
| 100 | Ballast Housing |
| 101 | Ballast Thru-Hole |
| 102 | Ballast Threaded Hole |
| 110 | Striker Housing |
| 111 | Striker Hole |
| 120 | Filter Housing |
| 121 | Filter Hole |
| 200 | Typical HID Light Fixture |
| 210 | Reflector |
| 220 | Housing |
| 221 | Partitioning Wall |
| 222 | Filter Capacitor Mounting Position |
| 223 | Transformer Mounting Position |
| 224 | Igniter Mounting Position |
| 225 | Housing Cover |
| 230 | Transformer Mounting Apparatus |
| 231 | Support Ledge |
| 232 | 1st Mounting Hole |
| 233 | 1st Support Column |
| 234 | 2nd Mounting Hole |
| 235 | 2nd Support Column |
| 236 | Mounting Bracket |
| 237 | 3rd Mounting Hole |
| 300 | Transformer |
| 301 | Metallic Coil |
| 302 | Core |
| 303 | Transformer Thru-Hole |
| 310 | Large Filter Capacitor |
| 320 | Igniter |

What is claimed is:

1. A segmented electronic ballast for a high-intensity discharge ("HID") lamp, the ballast comprising:

a first external housing containing at least a driver circuit of the electronic ballast, the driver circuit being configured to receive electrical power from a source of electrical power and being configured to output a conditioned power signal; and a second external housing distinct from the first housing, the second housing containing at least a striker circuit of the electronic ballast, the striker circuit being connected to the driver circuit and being configured to receive the conditioned power signal and to ignite the lamp.

2. The segmented electronic ballast of claim 1, further comprising a third external housing distinct from the first and the second housings, the third housing containing at least a filter circuit of the electronic ballast, the filter circuit being configured to prevent electrical noise generated by the segmented electronic ballast from propagating to the source of electrical power.

3. The segmented electronic ballast of claim 1, further comprising an interlock element configured to prevent activation of the driver circuit if the striker circuit is disconnected from the driver circuit.

4. The segmented electronic ballast of claim 3, wherein the interlock element is a circuit configured to detect the disconnection of the striker circuit.

5. The segmented electronic ballast of claim 3, wherein the interlock element is a micro-switch configured to detect the physical presence of the second housing within a fixture housing containing the lamp.

6. The segmented electronic ballast of claim 3, wherein the interlock element is a switch external to the first and the second housings that is built into the connection between the driver circuit and the striker circuit.

7. The segmented electronic ballast of claim 3, wherein the interlock element is a power jumper external to the first and the second housings that is included in the connection between the driver circuit and the striker circuit.

8. The segmented electronic ballast of claim 1, wherein the first housing includes a plurality of thru-holes configured so as to correspond to mounting holes for a transformer of a pre-existing magnetic ballast.

9. A method of drop-in replacement of a magnetic ballast for a high intensity discharge ("HID") lamp mounted on a fixture housing, the method comprising the steps of:

providing a segmented electronic ballast, the ballast comprising:

a first external housing containing at least a driver circuit of the electronic ballast, the driver circuit being configured to receive electrical power from a source of electrical power and being configured to output a conditioned power signal; and a second external housing distinct from the first housing, the second housing containing at least a striker circuit of the electronic ballast, the striker circuit being connected to the driver circuit and configured to receive the conditioned power signal and to ignite the lamp;

removing a transformer of the magnetic ballast from a transformer mounting position; and fixing the first housing of the segmented electronic ballast to the transformer mounting position.

10. The method of claim 9, further comprising the steps of:

removing a filter capacitor of the magnetic ballast from a filter capacitor mounting position; and fixing the second housing of the segmented electronic ballast to the filter capacitor mounting position.

11. The method of claim 9, further comprising the step of:

fixing the second housing of the segmented electronic ballast to the transformer mounting position.

12. The method of claim 10, further comprising the steps of:

removing an igniter of the magnetic ballast from an igniter mounting position; and fixing a third housing of the segmented electronic ballast to the igniter mounting position, the third housing containing at least a filter circuit of the electronic ballast, the filter circuit being configured to prevent electrical noise generated by the segmented electronic ballast from propagating to the source of electrical power.

13. The method of claim 10, further comprising the step of:

fixing a third housing of the segmented electronic ballast to the transformer mounting position, the third housing containing at least a filter circuit of the electronic ballast, the filter circuit being configured to prevent electrical noise generated by the segmented electronic ballast from propagating to the source of electrical power.

14. The method of claim 10, further comprising the step of:

fixing a third housing of the segmented electronic ballast to the filter capacitor mounting position, the third housing containing at least a filter circuit of the electronic ballast, the filter circuit being configured to prevent electrical noise generated by the segmented electronic ballast from propagating to the source of electrical power.

15. The method of claim 11, further comprising the step of:

fixing a third housing of the segmented electronic ballast to the transformer mounting position, the third housing containing at least a filter circuit of the electronic ballast, the filter circuit being configured to prevent electrical noise generated by the segmented electronic ballast from propagating to the source of electrical power.

16. The method of claim 9, wherein the transformer of the magnetic ballast is fixed to the transformer mounting position by a transformer mounting apparatus.

17. The method of claim 16, wherein the first housing of the segmented electronic ballast is fixed to the transformer mounting position by the transformer mounting apparatus.

18. The method of claim 17, wherein the transformer mounting apparatus is a plurality of mounting holes configured to cooperate with a plurality of fasteners.

19. The method of claim 17, wherein the transformer mounting apparatus is an interference fit formed by a surface of the fixture housing and a cover of the fixture housing.

20. The segmented electronic ballast of claim 1, wherein the first and the second housings are configured to be moved relative to one another.

21. The segmented electronic ballast of claim 1, wherein the first and the second housings are configured to be mounted in distinct compartments of a fixture housing containing the lamp.

22. The segmented electronic ballast of claim 1, wherein the first and the second housings are configured to be separately mounted on a fixture housing containing the lamp.

23. The segmented electronic ballast of claim 1, wherein the first housing includes at least one mounting element configured so as to correspond to at least one mounting element for a transformer of a pre-existing magnetic ballast.

24. The segmented electronic ballast of claim 23, wherein the at least one mounting element of the first housing is at least one external dimension of the first housing.

* * * * *